US006008793A

United States Patent [19]

Shigeta

[11] Patent Number: 6,008,793

[45] Date of Patent: Dec. 28, 1999

[54] DRIVE APPARATUS FOR SELF LIGHT EMITTING DISPLAY UNIT

[75] Inventor: Tetsuya Shigeta, Koufu, Japan

[73] Assignee: Pioneer Electronic Corporation, Tokyo, Japan

[21] Appl. No.: 08/890,752

[22] Filed: Jul. 11, 1997

[30] Foreign Application Priority Data

Sep. 20, 1996 [JP] Japan ..... 8-249634

[51] Int. Cl.[6] ..... G09G 5/10

[52] U.S. Cl. ..... 345/149; 345/147; 348/793

[58] Field of Search ..... 358/457, 455; 345/137, 138, 60, 148, 149, 147, 213; 348/448, 446, 793

[56] References Cited

U.S. PATENT DOCUMENTS

| | | | |
|---|---|---|---|
| 4,720,745 | 1/1988 | DeForest et al. | 358/166 |
| 4,956,638 | 9/1990 | Larky et al. | 345/199 |
| 5,093,721 | 3/1992 | Rabii | 358/135 |
| 5,347,314 | 9/1994 | Faroudja et al. | 348/448 |
| 5,428,397 | 6/1995 | Lee et al. | 348/448 |
| 5,475,448 | 12/1995 | Saegusa | 348/797 |
| 5,532,751 | 7/1996 | Lui | 348/452 |
| 5,548,696 | 8/1996 | Kubota et al. | 395/135 |
| 5,703,968 | 12/1997 | Kuwahara et al. | 382/269 |
| 5,714,975 | 2/1998 | Spackman | 345/149 |
| 5,754,244 | 5/1998 | Kahlman | 348/448 |
| 5,784,116 | 7/1998 | Pan et al. | 348/453 |
| 5,818,419 | 9/1998 | Tajima et al. | 345/147 |
| 5,886,745 | 3/1999 | Muraji et al. | 348/448 |

OTHER PUBLICATIONS

Patent Abstracts of Japan, vol. 95, No. 9, Oct. 31, 1995 & JP 07 140926 A (Fujitsu Ltd.) Jun. 2, 1995 *Abstract.

Patent Abstracts of Japan, vol. 96, No. 8, Aug. 30, 1996 & JP 08 106279 A (Fujitsu General) Apr. 23, 1996 *Abstract.

T. Yamaguchi et al. "Improvement in PDP Picture Quality by Three–Dimensional Scattering of Dynamic False Contours" Digest of Technical Papers, Society for Information Display International Symposium, May 12–17, 1996; vol. 27 pp. 291–294, San Diego USA, XP002055281.

*Primary Examiner*—Richard A. Hjerpe
*Assistant Examiner*—Marthe Y Marc-Coleman
*Attorney, Agent, or Firm*—Sughrue, Mion, Zinn, Macpeak & Seas, PLLC

[57] ABSTRACT

A drive apparatus capable of driving a self light-emitting display unit in an linear scanning mode based on video signals, obtained by interlaced scanning, while maintaining a high image quality. Two different image processes are performed on pixel data obtained by sampling interlaced scanning originated video signal, yielding image-processed pixel data and interpolation pixel data. The self light-emitting display unit is driven in an linear scanning mode by treating the image-processed pixel data as pixel drive data associated with one of an odd line and an even line of the self light-emitting display unit and treating the interpolation pixel data as pixel drive data associated with the other one of the odd line and even line.

5 Claims, 7 Drawing Sheets

FIG. 6

| LUMINANCE LEVEL | DITHER COMPENSATION PIXEL DATA | FIRST CONVERSION TABLE | SECOND CONVERSION TABLE |
|---|---|---|---|
| | BITS 5 ~ 0 | AZ BITS 7 ~ 0 | BZ BITS 7 ~ 0 |
| 0 | 000000 | 00000000 | 00000000 |
| 1 | 000001 | 00000100 | 00000100 |
| 2 | 000010 | 00100000 | 00100000 |
| 3 | 000011 | 00100100 | 00100100 |
| 4 | 000100 | 00001000 | 00001000 |
| 5 | 000101 | 00001100 | 00001100 |
| 6 | 000110 | 00101000 | 00101000 |
| 7 | 000111 | 00101100 | 00101100 |
| 8 | 001000 | 00010000 | 00010000 |
| 9 | 001001 | 00010100 | 00010100 |
| 10 | 001010 | 00110000 | 00110000 |
| 11 | 001011 | 00110100 | 00110100 |
| 12 | 001100 | 00011000 | 00011000 |
| 13 | 001101 | 00011100 | 00011100 |
| 14 | 001110 | 00111000 | 00111000 |
| 15 | 001111 | 00111100 | 00111100 |
| 16 | 010000 | 10010000 | 00010001 |
| 17 | 010001 | 10010100 | 00101001 |
| 18 | 010010 | 10110000 | 00110001 |
| 19 | 010011 | 10110100 | 00110101 |
| 20 | 010100 | 10011000 | 00011001 |
| 21 | 010101 | 10011100 | 00011101 |
| 22 | 010110 | 10111000 | 00111001 |
| 23 | 010111 | 10111100 | 00111101 |
| 24 | 011000 | 10010001 | 10010001 |
| 25 | 011001 | 10010101 | 10010101 |
| 26 | 011010 | 10110001 | 10110001 |
| 27 | 011011 | 10110101 | 10110101 |
| 28 | 011100 | 10011001 | 10011001 |
| 29 | 011101 | 10011101 | 10011101 |
| 30 | 011110 | 10111001 | 10111001 |
| 31 | 011111 | 10111101 | 10111101 |

FIG. 7

| LUMINANCE LEVEL | DITHER COMPENSATION PIXEL DATA | FIRST CONVERSION TABLE | SECOND CONVERSION TABLE |
|---|---|---|---|
| | BITS 5 ~ 0 | AZ BITS 7 ~ 0 | BZ BITS 7 ~ 0 |
| 32 | 100000 | 01010001 | 10010010 |
| 33 | 100001 | 01010101 | 10010110 |
| 34 | 100010 | 01110001 | 10110010 |
| 35 | 100011 | 01110101 | 10110110 |
| 36 | 100100 | 01011001 | 10011010 |
| 37 | 100101 | 01011101 | 10011110 |
| 38 | 100110 | 01111001 | 10111010 |
| 39 | 100111 | 01111101 | 10111110 |
| 40 | 101000 | 01010010 | 01010010 |
| 41 | 101001 | 01010110 | 01010110 |
| 42 | 101010 | 01110010 | 01110010 |
| 43 | 101011 | 01110110 | 01110110 |
| 44 | 101100 | 01011010 | 01011010 |
| 45 | 101101 | 01011110 | 01011110 |
| 46 | 101110 | 01111010 | 01111010 |
| 47 | 101111 | 01111110 | 01111110 |
| 48 | 110000 | 11010010 | 01010011 |
| 49 | 110001 | 11010110 | 01010111 |
| 50 | 110010 | 11110010 | 01110011 |
| 51 | 110011 | 11110110 | 01110111 |
| 52 | 110100 | 11011010 | 01011011 |
| 53 | 110101 | 11011110 | 01011111 |
| 54 | 110110 | 11111010 | 01111011 |
| 55 | 110111 | 11111110 | 01111111 |
| 56 | 111000 | 11010011 | 11010011 |
| 57 | 111001 | 11010111 | 11010111 |
| 58 | 111010 | 11110011 | 11110011 |
| 59 | 111011 | 11110111 | 11110111 |
| 60 | 111100 | 11011011 | 11011011 |
| 61 | 111101 | 11011111 | 11011111 |
| 62 | 111110 | 11110111 | 11110111 |
| 63 | 111111 | 11111111 | 11111111 |

DRIVE APPARATUS FOR SELF LIGHT EMITTING DISPLAY UNIT

BACKGROUND OF THE INVENTION

1. Field of the Invention

The present invention relates to a drive apparatus for a self light-emitting display unit.

2. Description of the Related Art

As a method of allowing a plasma display panel as a self light-emitting display unit to present gradation display, there is known a method which divides the display period of one frame (field) into N sub-frames (sub-fields) to permit light emission only for the time corresponding to the weight on each bit position of N-bit display data (so-called sub-field method).

When pixel data consists of eight bits, for example, the display period of one frame is divided to eight sub-frames SF8, SF7, SF6, . . . , and SF1 in the order of a heavier weight to a lighter one. At this time, light emissions of 128 pulses, 64 pulses, 32 pulses, 16 pulses, 8 pulses, 4 pulses, 2 pulses and 1 pulse are carried out in the respective sub-frames SF8 to SF1. The light emissions in those eight sub-frames provide 256-gradation display.

This gradation display scheme however has such a problem that a more-like false outline which looks like a gradation-lost image is observed near the area on a flat image where the gradation level crosses the boundary of $2^n$ gradation levels, such as 128 or 64, which significantly degrades the display quality.

Japanese Unexamined Patent Publication No. Hei 7-271325 has proposed a gradation display scheme of equally dividing a sub-frame with a heavy weight into a plurality of sub-frames, separating them so as to prepare a plurality of light emission patterns which have the equal light emission time (the equal number of light emissions) but different light emission orders of the sub-frames, and changing the light emission pattern from one to another pixel by pixel (pseudo outline compensation data conversion) to suppress a pseudo outline.

This gradation display scheme however suffers an increased number of sub-frames in one frame period. Further, if the number of bits of pixel data is increased to improve the image quality, the number of sub-frames in one frame period is increased more.

The increase in the number of sub-frames in one frame period increases the addressing period for lighting a plasma display panel for light emission. This relatively shortens the sustain period as the light emission period, reducing the maximum luminescent.

In this respect, a dithering process which reduces the number of bits (the number of sub-frames) of pixel data and effects pseudo intermediate tone display is performed.

The dithering process expresses a single intermediate display level based on plural pieces of pixel data adjacent to one another. In the case where 8-bit equivalent gradation display is demonstrated using the upper six bits of pixel data in 8-bit pixel data, for example, first, dither coefficients different pixel by pixel in each set of four pixels adjoining right and left and up and down are added to pixel data. Then, the upper six bits of the dither-coefficients added pixel data are extracted to be used as a drive signal for the display panel. This dithering process generates a combination of four different intermediate display levels with four pixels, thus ensuring four times the 6-bit gradation display levels or 8-bit equivalent intermediate tone display.

In the case where an image is displayed on a plasma display based on video signals obtained by interlaced scanning as done in the NTSC system or the high vision system or the like, to compensate a low luminescent of emitted light, pixel data corresponding to odd rows (even rows) of the screen is also assigned directly to even rows (odd rows) for interpolation to drive the display by sequential scanning (linear scanning).

When linear scanning is carried out in the above-described manner after performing the aforementioned pseudo outline compensation data conversion and dithering process, light is emitted from two pixels, arranged in the vertical direction, based on the same pixel data. This raises a problem that dithering-oriented noise, dot interference caused by the pseudo outline compensation and the like are likely to appear more prominently.

SUMMARY OF THE INVENTION

Accordingly, it is a primary objective of the present invention to provide a drive apparatus capable of driving a self light-emitting display unit in an linear scanning mode based on video signals, obtained by interlaced scanning, while maintaining a high image quality.

To achieve this object, a drive apparatus for a self light-emitting display unit according this invention comprises an A/D converter for sampling a video signal, obtained by interlaced scanning, to yield pixel data corresponding to each pixel; image data processing means for performing an image data process on the pixel data to acquire image-processed pixel data and performing an image data process, different from the former image data process, on the pixel data to acquire interpolation data; and drive means for driving the self light-emitting display unit in an linear scanning mode by treating the image-processed pixel data as pixel drive data associated with one of an odd line and an even line of the self light-emitting display unit and treating the interpolation pixel data as pixel drive data associated with the other one of the odd line and even line.

BRIEF DESCRIPTION OF THE DRAWINGS

FIG. 6 is a diagram exemplifying first and second mode conversion tables in the pseudo outline compensation data converter 32;

FIG. 7 is a diagram further exemplifying first and second mode conversion tables in the pseudo outline compensation data converter 32;

DETAILED DESCRIPTION OF THE PREFERRED EMBODIMENT

A preferred embodiment of the present invention will now be described with reference to the accompanying drawings.

Figure 1:
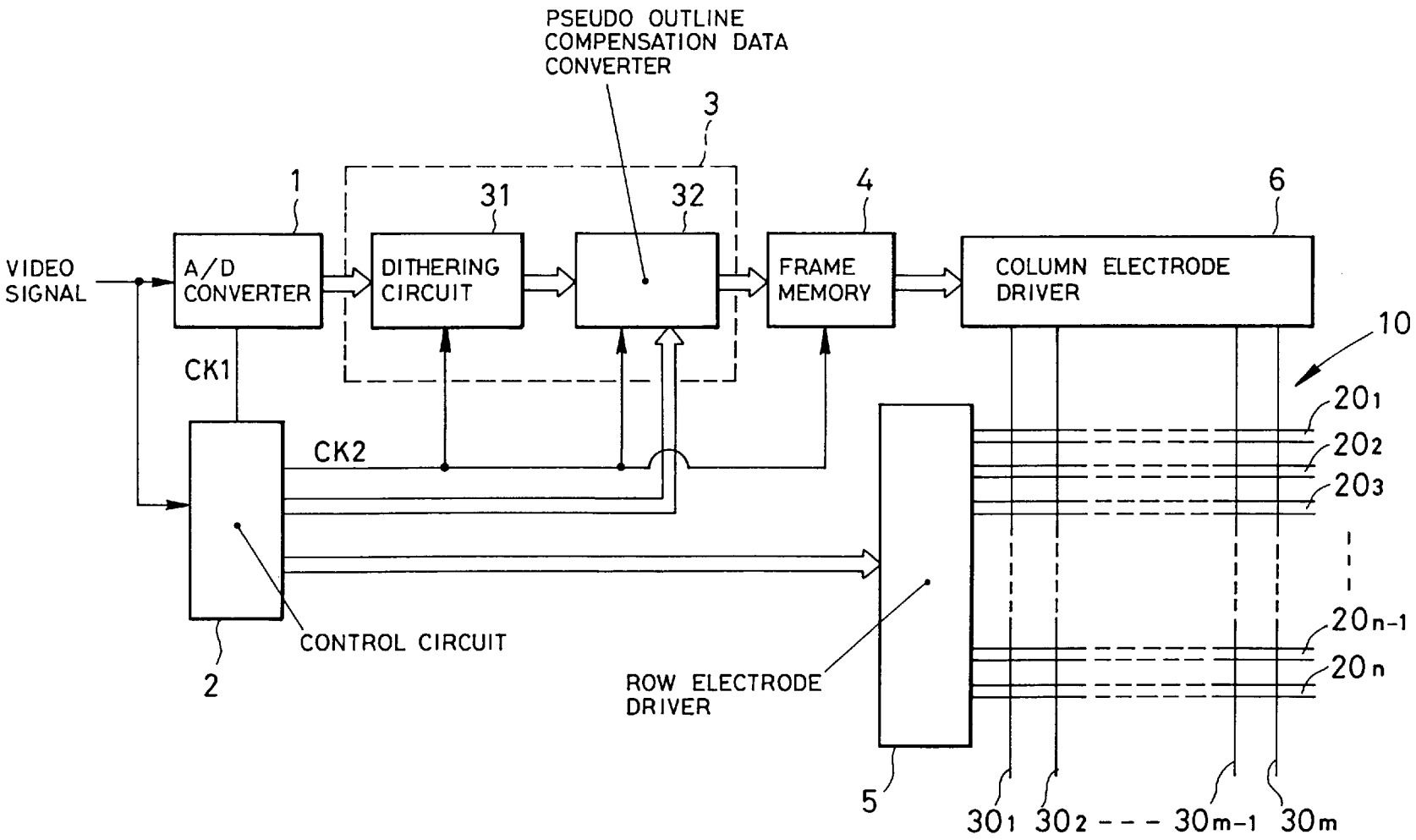
FIG. 1 is a diagram schematically illustrating the structure of a plasma display equipped with a drive apparatus according to this invention.

FIG. 1 is a schematic diagram illustrating the structure of a plasma display equipped with a drive apparatus according to this invention.

In FIG. 1, an A/D converter 1 samples an input video signal in accordance with a first clock signal CK1 of a frequency fs, supplied from a control circuit 2, to acquire N-bit pixel data D for each pixel and sequentially sends the pixel data D to an image data processor 3.

The image data processor 3 comprises a dithering circuit 31 for executing data processing in accordance with a second clock signal CK2 of a frequency 2·fs supplied from the control circuit 2, and a pseudo outline compensation data converter 32.

Those dithering circuit 31 and pseudo outline compensation data converter 32 carry out processing (which will be discussed later) on the pixel data D to accomplish pseudo intermediate tone display with a less number of bits in pixel data. The dithering circuit 31 and the pseudo outline compensation data converter 32 generate pseudo-outline compensated pixel data and supply the data to a frame memory 4.

The frame memory 4 sequentially writes the pixel data, sent from the image data processor 3, at every timing of the second clock signal CK2 from the control circuit 2. Further, the frame memory 4 reads the written pixel data at the timing of the second clock signal CK2 and sends it as pixel drive data to a column electrode driver 6.

The control circuit 2 generates the aforementioned first clock signal CK1 and second clock signal CK2, and further generates a reset timing signal, a scan timing signal, a sustain timing signal and an erase timing signal in accordance with horizontal and vertical sync signals of an input video signal and supplies those timing signals to a row electrode driver 5.

In accordance with those various timing signals, the row electrode driver 5 generates a reset pulse for initializing the amount of residual charges, a scan pulse for writing pixel data, a sustain pulse for sustaining the discharge light emission state and an erase pulse for stopping discharge light emission, and applies those pulses to pairs of row electrodes $\mathbf{20}_1$, to $\mathbf{20}_n$ of a PDP (Plasma Display Panel) 10. At this time, the scan pulse is sequentially applied to the pairs of row electrodes from $\mathbf{20}_1$ to $\mathbf{20}_n$.

The column electrode driver 6 divides one frame of pixel drive data read from the frame memory 4 into bits with the same weight, generates a pixel data pulse having a voltage value corresponding to a logic value "1" or "0" of that bit, and applies the pulse to column electrodes $\mathbf{30}_1$ to $\mathbf{30}_m$ of the PDP 10.

Figure 2:
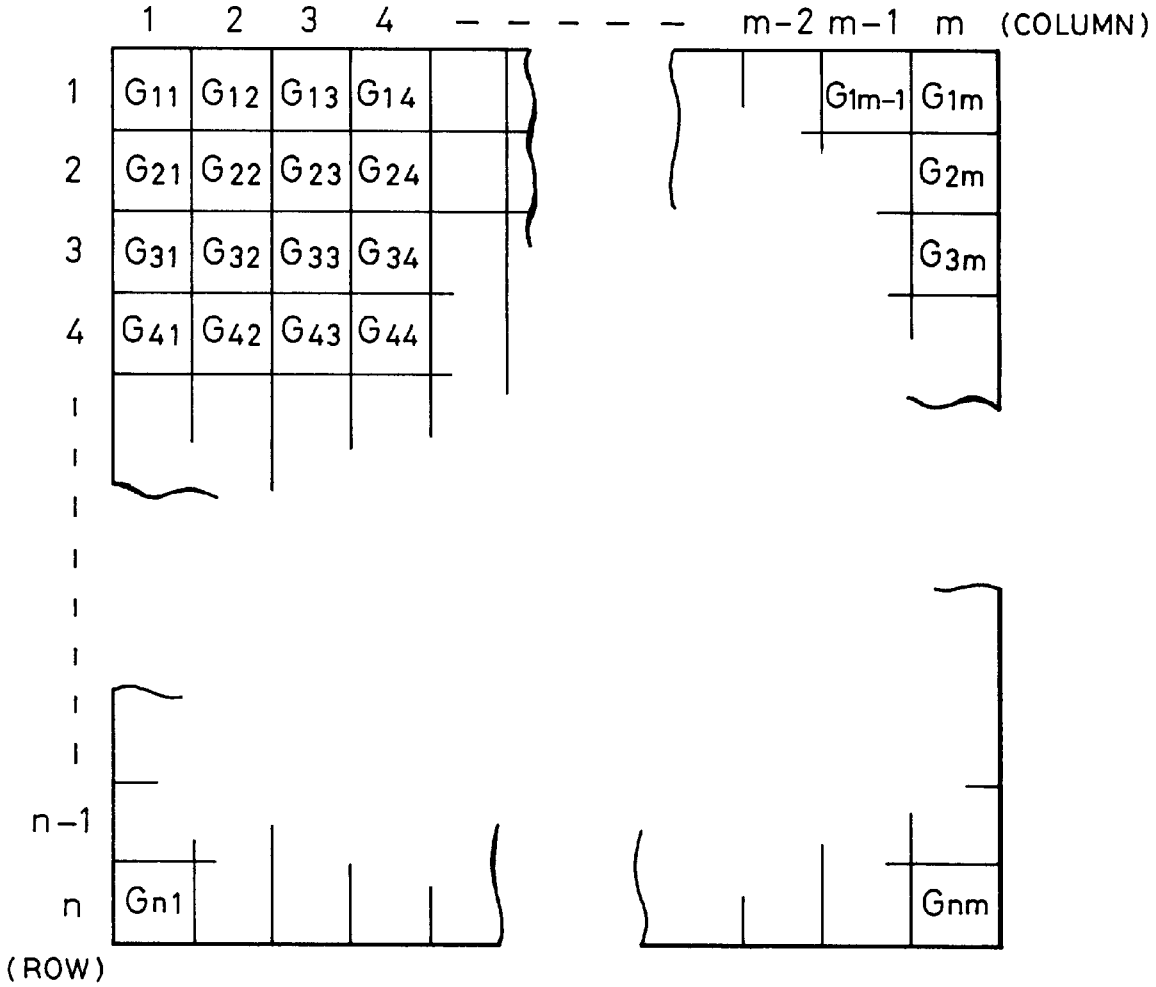
FIG. 2 is a diagram showing positions of individual pixels on a screen.

When the scan pulse is applied to the PDP 10 while the pixel data pulse from the column electrode driver 6 is applied, a charge corresponding to the applied pixel data pulse is written in the PDP 10. At this time, light emission occurs at the intersection of a column electrode applied with the pixel data pulse corresponding to, for example, logic "1" and a row electrode pair applied with the scan pulse. This intersection is equivalent to each pixel G on the screen of the PDP 10 as shown in FIG. 2. When the sustain pulse is applied by the row electrode driver 5 thereafter, the light emission state is maintained for the time corresponding to the number of the sustain pulses applied. A viewer would visually sense the luminescence corresponding to the time for sustaining the light emission state.

The operation of the image data processor 3 will now be discussed with reference to the signal waveforms for the internal operation illustrated in FIG. 3.

Figure 4:
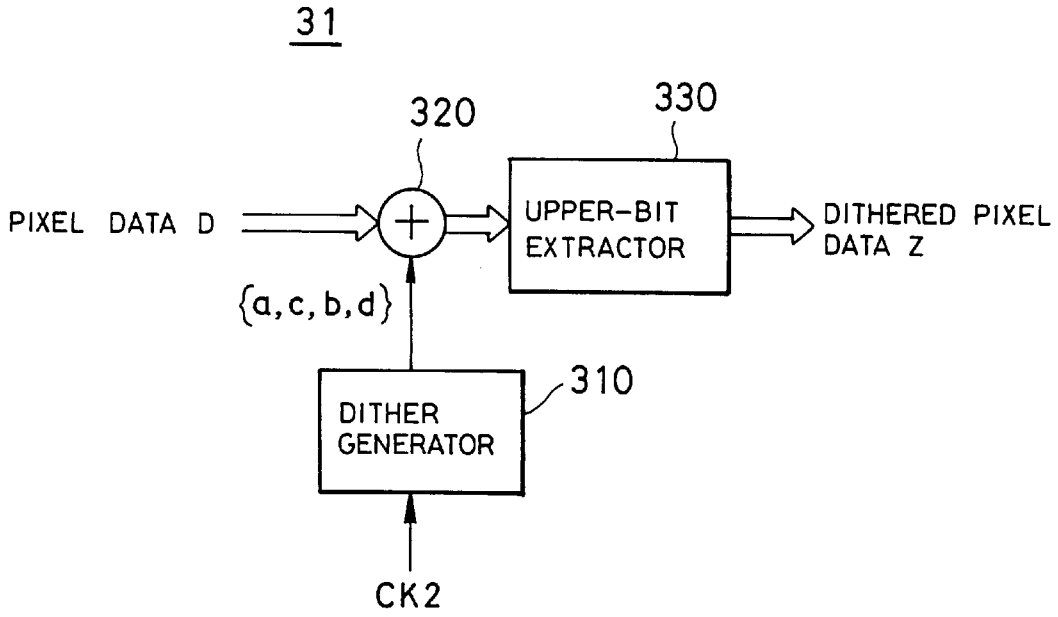
FIG. 4 is a diagram showing the internal structure of a dithering circuit 31.

FIG. 4 shows the internal structure of the dithering circuit 31 in the image data processor 3.

Figure 3:
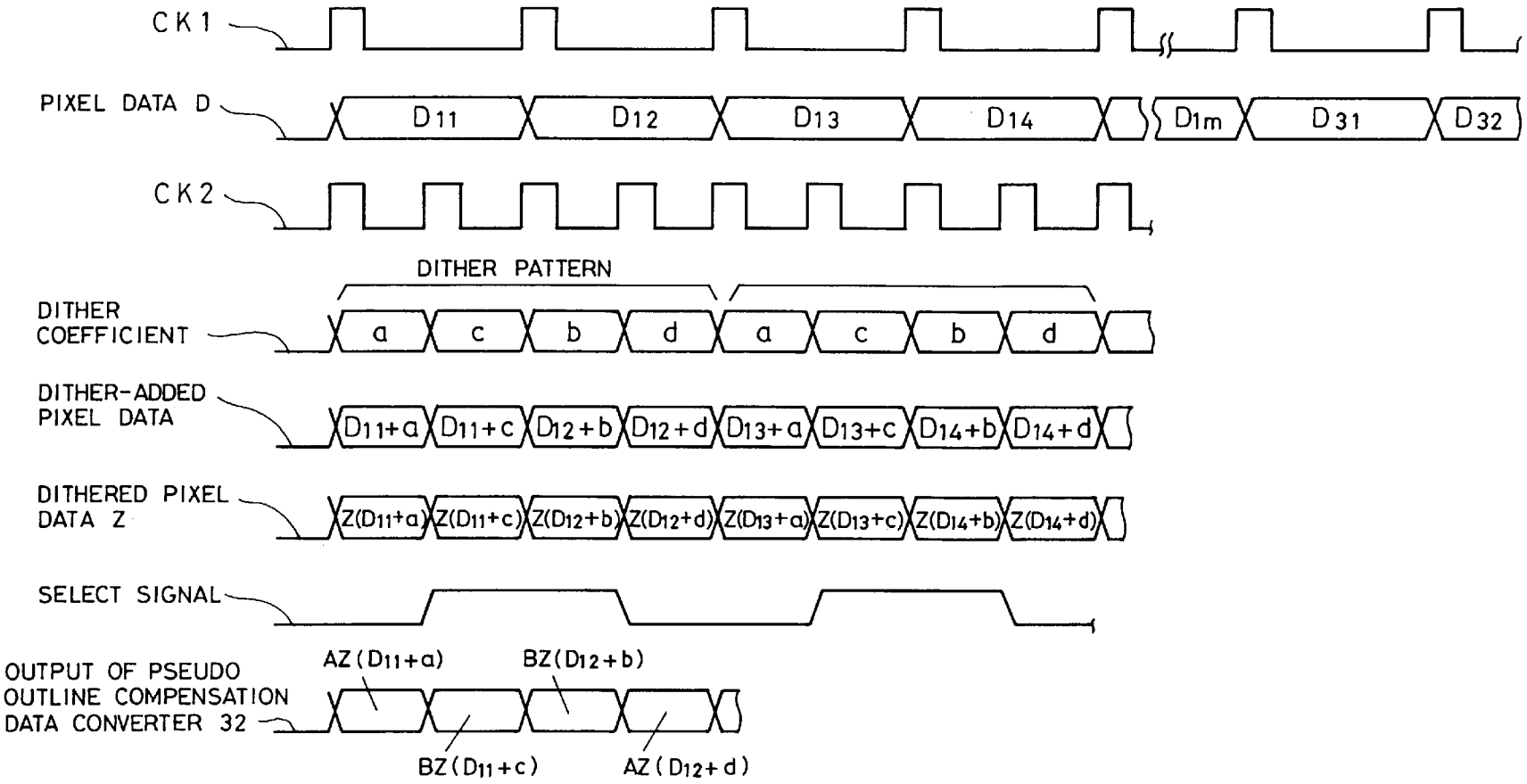
FIG. 3 is a diagram illustrating signal waveforms for the internal operation of an image data processor 3.

Referring to FIG. 4, N-bit pixel data D for each pixel corresponding to a video signal is sequentially supplied to an adder 320 for each first clock signal CK1 of a frequency fs as shown in FIG. 3. Since this video signal has been produced by interlaced scanning, pixel data corresponding to an odd row of pixels in the entire pixels of the PDP 10 shown in FIG. 2 are supplied first, and then pixel data corresponding to an even row of pixels are supplied. As shown in FIG. 3, for example, after pixel data $D^{11}$–$D_{1m}$ respectively corresponding to the first row of pixels $G_{11}$–$G_{1m}$ of FIG. 2 are supplied, pixel data $D_{31}$–$D_{3m}$ respectively corresponding to the next row or the third row of pixels $G_{31}$–$G_{3m}$ are supplied. When pixel data Dm1–Dmn respectively corresponding to the last odd row of pixels $G_{n1}$–$G_{nm}$ are supplied, pixel data $D_{21}$–$D_{2m}$. respectively corresponding to the first even row of pixels $G_{21}$–$G_{2m}$ are supplied.

A dither generator 310 repeatedly generates a dither coefficient a, dither coefficient c, dither coefficient b and dither coefficient d in circulation for each second clock signal CK2 of a frequency 2·fs as shown in FIG. 3, and supplies those dither coefficients to the adder 320. The adder 320 adds those dither coefficients to the pixel data D sequentially supplied from the A/D converter 1, and sends the resultant dither-added pixel data to an upper-bit extractor 330.

Referring to FIG. 3, for example, the dither coefficient a is added to the pixel data $D_{11}$ at the first row and the first column to acquire dither-added pixel data ($D_{11}$+a), and then the dither coefficient c is added to the pixel data $D_{11}$ to acquire dither-added pixel data ($D_{11}$+c). Subsequently, the dither coefficient b is added to the pixel data $D_{12}$ at the first row and the second column to acquire dither-added pixel data ($D_{12}$+b), and then the dither coefficient d is added to the pixel data $D_{12}$ to acquire dither-added pixel data ($D_{12}$+d)

In other words, two different dither coefficients (the dither coefficients a and c, or the dither coefficients b and d) are added to a single piece of pixel data to newly generate two pieces of dither-added pixel data.

The upper-bit extractor 330 extracts upper M bits of data of such dither-added pixel data and supplies the data as dithered pixel data Z to the pseudo outline compensation data converter 32 at the subsequent stage.

When N is "8" and M is "6", i.e., when the pixel data D for each pixel supplied from the A/D converter 1 consists of eight bits and the number of upper bits to be extracted by the upper-bit extractor 330 is "6", the patterns of the dither coefficients a to d are set as follows.

dither coefficient a=0 dither coefficient b=3 dither coefficient c=2 dither coefficient d=1

Figure 5:
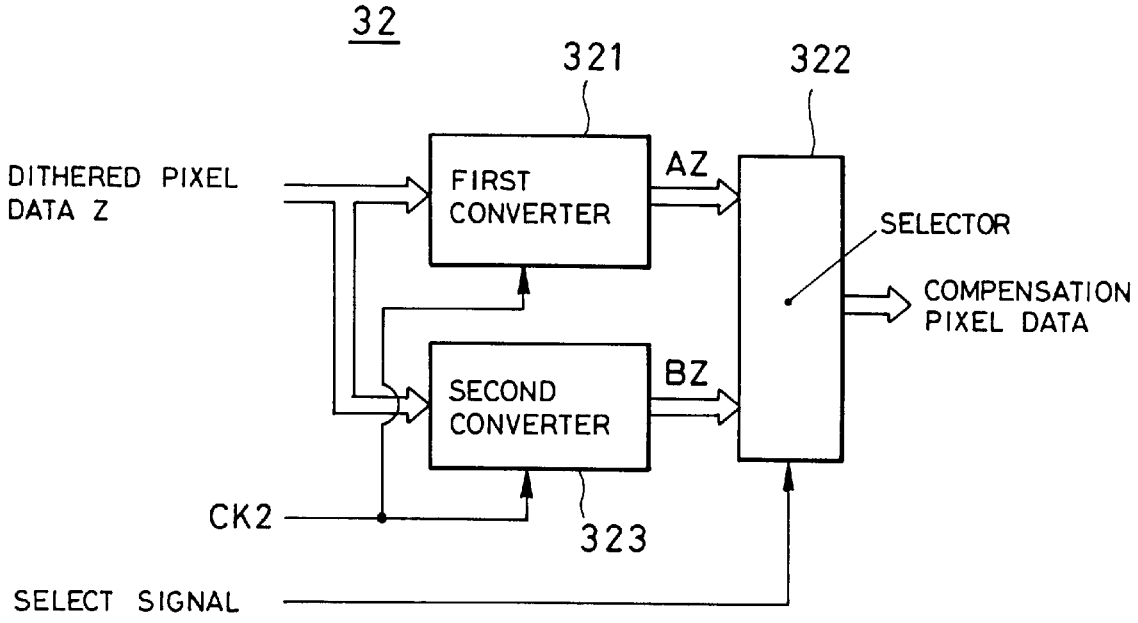
FIG. 5 is a diagram showing the internal structure of a pseudo outline compensation data converter 32.

FIG. 5 shows the internal structure of the pseudo outline compensation data converter 32

Referring to FIG. 5, a first converter 321 converts the dithered pixel data Z consisting of, for example, six bits supplied from the dithering circuit 31 to 8-bit pixel data based on a first mode conversion table as shown in FIG. 6 or 7, and supplies the converted data as pseudo outline compensation pixel data AZ to a selector 322. Meanwhile, a second converter 323 converts the dithered pixel data Z consisting of, for example, six bits supplied from the dithering circuit 31 to 8-bit pixel data based on a second mode conversion table as shown in FIG. 6 or 7, and supplies the converted data as pseudo outline compensation pixel data BZ to the selector 322.

The logic value "0" of each bit in the pseudo outline compensation pixel data AZ (BZ) shown in FIG. 6 or 7 designates no light emission while the logic value "1" designates light emission. The light emission period in one frame period accords to the light emission format in FIG. 8.

Figure 8:
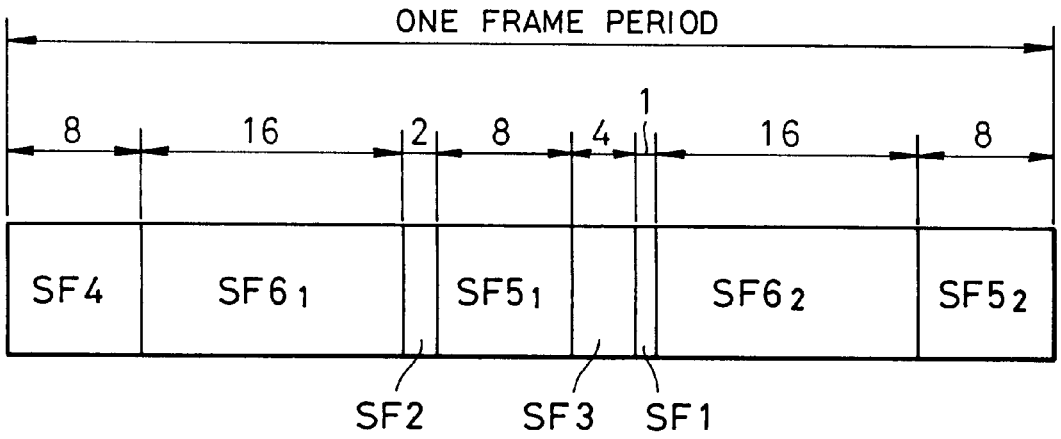
FIG. 8 is a diagram showing a light emission format in terms of sub-frames.

For example, bit 7 of the pseudo outline compensation pixel data AZ corresponds to light emission in the sub-frame SF4 in FIG. 8, and when its logic value is "1", light emission is carried out for the period of "8". Bit 6 corresponds to light emission in the sub-frame SF$\mathbf{6}_1$, and when its logic value is "1", light emission is carried out for the period of "16". Bit 5 corresponds to light emission in the sub-frame SF2, and when its logic value is "1", light emission is carried out for the period of "2". Bit 4 corresponds to light emission in the sub-frame SF$\mathbf{5}_1$, and when its logic value is "1", light emission is carried out for the period of "8". Bit 3 corresponds to light emission in the sub-frame SF3, and when its logic value is "1", light emission is carried out for the period of "4". Bit 2 corresponds to light emission in the sub-frame SF1, and when its logic value is "1", light emission is carried out for the period of "1". Bit 1 corresponds to light emission in the sub-frame SF$\mathbf{6}_2$, and when its logic value is "1", light emission is carried out for the period of "16". Further, bit 0 corresponds to light emission in the sub-frame SF$\mathbf{5}_2$, and when its logic value is "1", light emission is carried out for the period of "8". The sum of the light emission periods in those SF1–SF6 is equivalent to the luminance level.

At this time, the sub-frame SF6 (equivalent to the light emission period of "32") which has a heavy weight is separated to the sub-frames SF$\mathbf{6}_1$ and SF$\mathbf{6}_2$ each specifying the light emission period of "16" and both arranged apart from each other. Further, the sub-frame SF5 (equivalent to the light emission period of "16") which also has a heavy weight is separated to the sub-frames SF$\mathbf{5}_1$ and SF$\mathbf{5}_2$ each specifying the light emission period of "8" and both arranged apart from each other. Two conversion patterns that have different light emission positions in sub-frames in one frame, whose total light emission periods are the same and whose light emission periods are equal to one another, are prepared in the first and second mode conversion tables to suppress a pseudo outline.

With regard to the pseudo outline compensation pixel data AZ equivalent to the luminance level "16" in FIG. 6, for example, light emission for the period of "8" is carried out at the positions of the sub-frames SF4 and SF$\mathbf{5}_1$ shown in FIG. 8, while for the pseudo outline compensation pixel data BZ equivalent to the luminance level "16", light emission for the period of "8" is carried out at the positions of the sub-frames SF$\mathbf{5}_1$ and SF$\mathbf{5}_2$.

Even with the same luminance level, a pseudo outline can be suppressed by shifting the position of light emission in one frame period from one pixel to another adjacent pixel in the aforementioned manner.

Driving for such light emission is carried out by the row electrode driver 5 and the column electrode driver 6.

Data conversions by the first converter 321 and the second converter 323 are executed in synchronism with the second clock signal CK2.

The selector 322 selects one of the pseudo outline compensation pixel data AZ supplied from the first converter 321 and the pseudo outline compensation pixel data BZ supplied from the second converter 323 which accords to the logic value of a select signal supplied from the control circuit 2 as shown in FIG. 3, and sends the selected one to the frame memory 4.

When the logic value of the select signal is "0" in FIG. 3, the selector 322 selects the pseudo outline compensation pixel data AZ supplied from the first converter 321 and sends it to the frame memory 4. When the logic value of the select signal is "1", on the other hand, the selector 322 selects the pseudo outline compensation pixel data BZ supplied from the second converter 323 and sends it to the frame memory 4.

The operations of the dithering circuit 31 and the pseudo outline compensation data converter 32 permit the first compensation pixel data AZ ($D_{11}$+a) and the second compensation pixel data BZ ($D_{11}$+c) to be generated based on the pixel data $D_{11}$ supplied in association with the pixel $G_{11}$ in FIG. 2 and to be stored in the frame memory 4. Further, the first compensation pixel data BZ ($D_{12}$+b) and the second compensation pixel data AZ ($D_{12}$+d) are generated based on the pixel data $D_{12}$ associated with the pixel $G_{12}$ in FIG. 2 and are stored in the frame memory 4.

Figure 9:
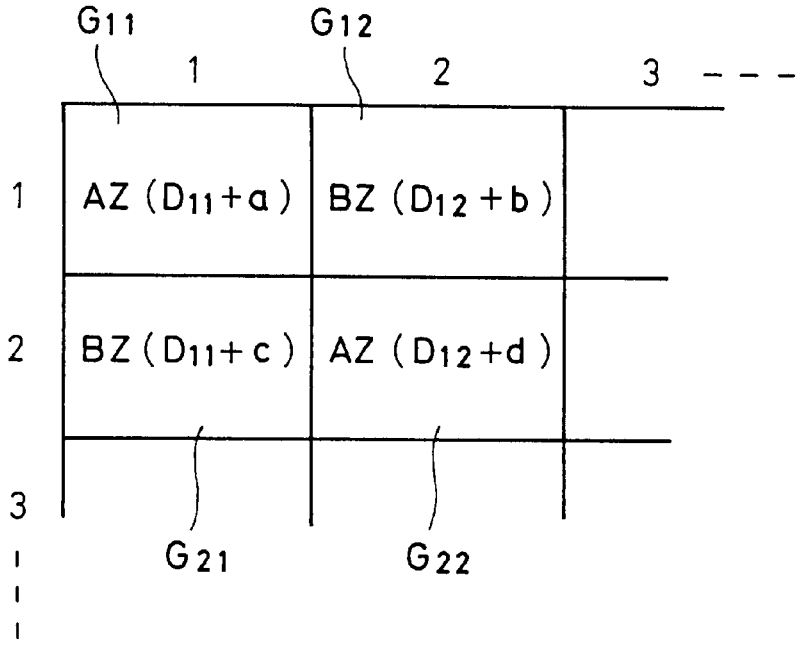
FIG. 9 is a diagram exemplifying the association of individual pixels with compensation pixel data.

As shown in FIG. 9, the first compensation pixel data AZ($D_{11}$+a) is read out from the frame memory 4 as pixel drive data corresponding to the pixel $G_{11}$ at the first row and first column, and the first compensation pixel data BZ($D_{12}$+b) is read out from the frame memory 4 as pixel drive data corresponding to the pixel $G_{12}$ at the first row and second column.

Furthermore, as shown in FIG. 9, the second compensation pixel data BZ($D_{11}$+c) is read out from the frame memory 4 as pixel drive data corresponding to the pixel $G_{21}$ at the second row and first column, and the second compensation pixel data AZ($D_{12}$+d) is read out from the frame memory 4 as pixel drive data corresponding to the pixel $G_{22}$ at the second row and second column.

At this time, the first compensation pixel data AZ($D_{11}$+a) and BZ($D_{12}$+b) are image-processed pixel data which is the supplied pixel data corresponding to the first row having undergone image processing by the image data processor 3. The second compensation pixel data BZ($D_{11}$+c) and AZ($D_{12}$+d) are compensation pixel data corresponding to the second row interpolated on the basis of the first row of pixel data.

Pixel drive data respectively corresponding to those image-processed pixel data and interpolation pixel data are sequentially read from the frame memory 4 from the one that corresponds to the first row, and are supplied to the column electrode driver 6. This operation permits display in an linear scanning mode to be effected based on the video signal produced by the interlaced scanning.

According to the drive apparatus embodying this invention, as apparent from the above, two different image processes are performed on pixel data obtained by sampling interlaced scanning originated video signal, yielding image-processed pixel data and interpolation pixel data. The self light-emitting display unit is driven in an linear scanning mode by treating the image-processed pixel data as pixel drive data associated with one of an odd line and an even line of the self light-emitting display unit and treating the interpolation pixel data as pixel drive data associated with the other one of the odd line and even line.

In short, this invention is effective in that at the time a video signal of a interlaced scanning mode is converted to a video signal of an linear scanning mode which is to be displayed, noise and dot interference on the screen, which are originated from image processing, are suppressed, advantageously.

The foregoing description of this invention has been given with reference to one preferred embodiment. It should however be apparent to those skilled in the art that this invention may be changed or modified in various forms all within the scope of the appended claims.

What is claimed is:

1. A drive apparatus for a self light-emitting display unit, comprising:

an A/D converter for sampling a video signal, obtained by interlaced scanning, to yield pixel data corresponding to each pixel;

image data processing means for performing a first image data process on said pixel data to acquire image-processed pixel data and performing a second image data process, different from the first image data process, on said pixel data to acquire interpolation data; and drive means for driving said self light-emitting display unit in a linear scanning mode by treating said image-processed pixel data as pixel drive data associated with one of an odd line and an even line of said self light-emitting display unit and treating said interpolation pixel data as pixel drive data associated with the other one of said odd line and even line.

2. The drive apparatus according to claim 1, wherein said image data processing means is a pseudo outline compensation data converter comprising:

a first conversion means for converting said pixel data based on a first conversion table to acquire first pseudo outline compensation pixel data;

a second conversion means for converting said pixel data based on a second conversion table different from said first conversion table to acquire second pseudo outline compensation pixel data; and selection means for selecting one of said first and second pseudo outline compensation pixel data as said image-processed pixel data and selecting the other one as said interpolation pixel data.

3. The drive apparatus according to claim 1, wherein said drive means divides one frame into a plurality of sub-frames having light emission periods corresponding to individual bit positions of said pixel drive data and further divides a sub-frame corresponding to a bit position with a heavy weight into a plurality of sub-frames, thereby allowing pixels of said self light-emitting display unit to emit light only in those sub-frames associated with said pixel drive data; and each of said first and second conversion tables is a conversion pattern for converting a bit pattern of said pixel data in such a manner that light emission positions in sub-frames having an equal light emission period become different from one another.

4. The drive apparatus according to claim 1, wherein said image data processing means includes a dithering circuit for performing a dithering process by adding a first dither coefficient to said pixel data and adding a second dither coefficient different from said first dither coefficient to said pixel data.

5. The drive apparatus according to claim 1, wherein said image data processing means and said drive means perform image data processing at a clock rate twice a rate of said sampling to convert a video signal, produced by said interlaced scanning, to pixel drive data in a linear scanning form.

* * * * *